United States Patent [19]

Beyer et al.

[11] 4,278,444

[45] Jul. 14, 1981

[54] LIQUID HYDROCARBONS CONTAINING A FLUORESCENT COMPOUND

[75] Inventors: Robert E. Beyer, Pennington; John P. Magoulas, Belle Mead, both of N.J.

[73] Assignee: Mobil Oil Corporation, New York, N.Y.

[21] Appl. No.: 142,799

[22] Filed: Apr. 22, 1980

[51] Int. Cl.[3] ..... C10L 1/18

[52] U.S. Cl. ..... 44/59; 44/65

[58] Field of Search ..... 44/59, 65; 250/302; 260/358

[56] References Cited

U.S. PATENT DOCUMENTS

| | | | |
|---|---|---|---|
| 1,725,590 | 8/1929 | Lüttringhaus et al. | 260/358 |
| 2,932,741 | 4/1960 | McKay | 250/302 |

*Primary Examiner*—Winston A. Douglas
*Assistant Examiner*—Y. Harris Smith
*Attorney, Agent, or Firm*—Charles A. Huggett; Michael G. Gilman; James D. Tierney

[57] ABSTRACT

Method of determining the presence of one or more liquid hydrocarbons in a liquid hydrocarbon mixture, the method having the step of adding to the hydrocarbon or hydrocarbons to be detected a minor amount of an alkylated isodibenzanthrone.

5 Claims, No Drawings

LIQUID HYDROCARBONS CONTAINING A FLUORESCENT COMPOUND

BACKGROUND OF THE INVENTION

1. Field of the Invention

This invention relates to a method of detecting one or more liquid hydrocarbons in a mixture of liquid hydrocarbons. More particularly, it relates to the use of a fluorescent compound invisible to the naked eye.

2. Discussion of the Prior Art

Heretofore gasolines and other fuels have had added to them certain dyes to identify and to segregate them. U.S. Pat. No. 3,164,449, for example, discloses the use of anthraquinone dyes for use in gasoline, as do U.S. Pat. No. 3,435,054 and U.S. Pat. No. 3,597,257.

However, detection has been difficult, if not impossible, in those instances in which some individuals have mixed gasolines of the same type, but of different grades. Thus, mixing of premium leaded gasolines with regular leaded gasolines is not unknown. With the advent of the unleaded gasolines, both "regular" and "premium", there are known instances in which these have been mixed.

Applicants know of no prior art teaching the use of alkylated isodibenzanthrone to detect the presence of, for example, a regular unleaded mixed with a premium unleaded. There are two known references from the Oil and Gas Journal that disclose the use of "131 Super Concentrate," which is the designation of the fluorescent material utilized herein to detect batch changes in liquid-petroleum product pipelines. These are "Fluorometer, Dye Spot Interfaces" by F. F. Shamp, Oil and Gas Journal For September, 1965, and "Interface-detection systems tests," by G. M. Jeffanes et al., Oil and Gas Journal, May 14, 1973.

SUMMARY OF THE INVENTION

In accordance with the invention, there is provided a method for detecting the presence of a regular unleaded gasoline or premium unleaded gasoline in a mixture of these gasolines, or in mixtures of one or more of these with leaded gasolines or other fluids, the method comprising the steps of adding to one of the unleaded gasolines, prior to mixing, a minor amount of an alkylated isodibenzanthrone and determining its presence by appropriate means.

DESCRIPTION OF SPECIFIC EMBODIMENTS

The invention is practiced by adding from about 0.1 ppm to about 3.0 ppm of the isodibenzanthrone to the liquid hydrocarbon. Since the isodibenzanthrone used herein is detectable at concentrations of less than 0.5 ppm, the stated amount thereof will provide enough of the marker to be detectable even if the hydrocarbon mixture contains as little as 10%, or less, of the liquid marked for detection.

The alkyl isodibenzanthrone utilized in this invention has the formula

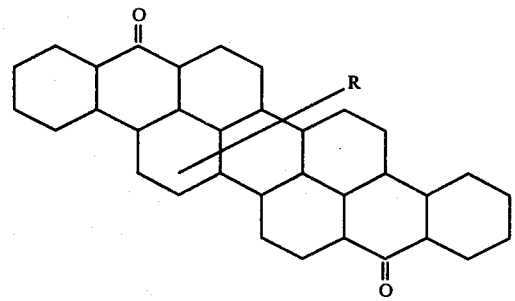

wherein R is an alkyl group. As the formula indicates, R is attached at at least one unknown position on the ring. It does not form an -OR radical upon reaction.

The isodibenzanthrone per se can be made in small amounts from the alkaline fusion of benzanthrone to give dibenzanthrone. It can, however, also be made in accordance with U.S. Pat. No. 2,716,652. Example 2 of the patent teaches the synthesis of the chemical by reacting a melt of potassium acetate, sodium acetate, sodium sulfide, sulfur and Bz-1-bromobenzanthrone and then stirring at elevated temperature (about 200° C.) for a specified time.

The alkylated isodibenzanthrone is available commercially from Morton Chemical Company as Color No. 131 Super Concentrate.

The isodibenzanthrone is effective for the purposes of this invention when it is added to the specified gasolines and then mixed with other liquid hydrocarbon combustion fuels, including the distillate fuels, i.e. gasolines and fuel oils. The fuel oils include hydrocarbon fractions having an initial boiling point of at least about 100° F. and an end-boiling point no higher than about 750° F., and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas, and the like, with cracked distillate stocks. Moreover, such fuel oils can be treated in accordance with well-known commercial methods, such as acid or caustic treatment, hydrogenation, solvent refining, clay treatment, etc.

The distillate fuels oils are characterized by their relatively low viscosities, pour points, and the like. The principal property which characterizes the contemplated hydrocarbons, however, is the distillation range. As mentioned hereinbefore, this range will lie between about 100° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuels oils are Nos. 1 and 2 fuel oils used in heating and as diesel fuel oils, and the jet combustion fuels. The domestic fuel oils generally conform to the specifications set forth in ASTM Specifications D396-48T. Specifications for diesel fuels are defined in ASTM Specification D975-48T. Typical jet fuels are defined in Military Specification MIL-F-5624B.

The gasolines contemplated are mixtures of hydrocarbons having an initial boiling point falling between about 75° F. and about 135° F. and an end-boiling point falling between about 250° F. and about 450° F. As is well known in the art, motor gasoline can be straight run gasoline or, as is more usual, it can be a blend of two or more cuts of materials including straight run stock, catalytic or thermal reformate, cracked stock, alkylated natural gasoline, and aromatic hydrocarbons.

In general, the method for detecting the unleaded gasoline in the presence of other fuels involves the use of fluorescence spectroscopy, at the concentrations specified hereinabove. Details of the method will be set forth in connection with the Example.

EXAMPLE

This Example illustrates the fluorescence of the gasoline-isodibenzanthrone composition. It is not to be construed as limiting the invention in any way.

Some typical properties of the alkyl isodibenzanthrone used are:

TABLE 1

| Absorbance maximum | |
|---|---|
| Heptane | 526 nm |
| Moisture ASTM D-95 | 0.2% maximum |
| Insolubles | 1% maximum |
| Flash point, Cleveland Open Cup | 200° F. |

A stock solution is prepared by dissolving 0.5 g of the alkyl isodibenzanthrone (dye) in a small amount of cyclohexane. A working standard solution of this is made by pipetting 10 ml of the stock solution into a one liter flask and filling to the mark with cyclohexane. A series of analytical standards is prepared from this latter solution by pipetting aliquots thereof into a 100 ml. volumetric flask and diluting to the mark with unleaded gasoline. The resulting analytical samples contain from 0.1 mg/l to 2.0 mg/l of the dye.

A standard curve is constructed by running the analytical samples on a fluorescence spectrophotometer and plotting the maximum fluorescence intensity at 536 nm versus concentration for each of the analytical samples. This is done under the conditions shown in the following Table.

TABLE 2

| DETERMINATION OF UNLEADED GASOLINE MIXING OF FLUORESCENCE SPECTROSCOPY SPECTROFLUOROMETER OPERATING CONDITIONS | |
|---|---|
| Excitation Slit | 5 nm |
| Emission Slit | 5 nm |
| Excitation Wavelength | 490 nm (fixed) |
| Emission Wavelength | 490 nm scan to 500 nm |
| Scan Speed - Emission | 60 nm/min |
| Mode | Normal |
| Response | Normal |
| Zero Suppression | Off - unless unusual background interference exists |
| PM Gain Selector | Normal |
| Sensitivity - Range and Fine | Use a 2.0 mg/l standard to maximize the amount of fluorescence to nearly full scale. Do this by setting the excitation wavelength to 490 nm and the emission wavelength to 536 nm and vary the sensitivity until full scale pen deflection is obtained. |

Regular Mobil unleaded gasoline is treated with sufficient dye to give the desired concentration thereof. Mixtures of this unleaded gasoline and super unleaded gasoline are prepared such that the mixture contains less than 0.5 ppm of the dye. Samples from this mixture are run under the same conditions as used for the standards. The percent dilution, which is one measure of the amount of unleaded gasoline present is found using the formula:

% dilution=(amount of dye in the sample X 100)/(amount of dye in the original, dyed sample.)

The lower limit of detection for the amount of dye in unleaded gasoline can be extended ten times by using the column clean-up procedure. A set of standards with 10 times less dye must be prepared. This is done by diluting a 10 ml aliquot of the above standards in 90 ml of unleaded base gasoline in volumetric flasks. The standard curve is run in the same manner with an appropriate increase in sensitivity of the spectrophotometer.

For distillate products and gasoline other than Mobil Unleaded, the following procedure is used.

Fifteen g of grade 12 silica gel is placed in a chromatography column. If No. 2 Fuel is being analyzed, 7 g of activated charcoal is substituted for the silica gel.

Standards are prepared as already described, using the hydrocarbon product that is of interest. If kerosine, e.g., is the product being analyzed, then the standards should be prepared in kerosine that is known to be free of the fluorescent dye.

Twenty-five ml of the standards, blank and sample are poured through individual silica gel (or charcoal for No. 2 Fuel Oil) columns. The first 5.0 ml of the column eluates are collected in 5 ml volumetric flasks, discarding the eluate that is in excess of the 5 ml volume.

The fluorescence spectrum of the eluates, the blank, standards and samples are obtained as previously described.

We claim:

1. A method for detecting the presence of regular unleaded or super unleaded gasoline and a mixture of these gasolines, or in mixtures of one or more of these with leaded gasolines or other fuels, the method comprising the steps of adding to one of the unleaded gasolines, prior to mixing, a minor amount, up to about 0.3 ppm, of an alkylated isodibenzanthrone and then determining the presence of said alkylated isodibenzanthrone by spectrographic means, after the unleaded gasoline is mixed with other gasolines.

2. The method of claim 1 wherein the isodibenzanthrone is added to the regular unleaded gasoline.

3. The method of claim 2 wherein the treated regular unleaded gasoline is detected in the presence of super unleaded gasoline.

4. The method of claim 1 wherein the isodibenzanthrone is added to the super unleaded gasoline.

5. The method of claim 4 wherein the treated super unleaded gasoline is detected in the presence of regular unleaded gasoline.

* * * * *